US006634897B2

(12) United States Patent
Cykon et al.

(10) Patent No.: US 6,634,897 B2
(45) Date of Patent: Oct. 21, 2003

(54) TWIST-LOCK CONNECTOR

(75) Inventors: James Cykon, Warren, OH (US); John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/177,160

(22) Filed: Jun. 24, 2002

(65) Prior Publication Data

US 2002/0197899 A1 Dec. 26, 2002

Related U.S. Application Data

(60) Provisional application No. 60/300,460, filed on Jun. 26, 2001.

(51) Int. Cl.[7] ..... H01R 13/62
(52) U.S. Cl. ..... 439/320; 439/695; 439/318
(58) Field of Search ..... 439/320, 321, 439/315, 316, 318, 695

(56) References Cited

U.S. PATENT DOCUMENTS

| | | | | |
|---|---|---|---|---|
| 3,124,404 A | * | 3/1964 | Chesnov | 439/131 |
| 3,517,371 A | * | 6/1970 | Buckley | 439/321 |
| 3,552,777 A | | 1/1971 | Heinrich et al. | |
| 3,786,396 A | | 1/1974 | Kemmer et al. | |
| 4,029,953 A | | 6/1977 | Natoli | |
| 4,070,080 A | | 1/1978 | Eshleman et al. | |
| 4,074,927 A | | 2/1978 | Ball | |
| 4,148,542 A | | 4/1979 | Wood | |
| 4,191,443 A | | 3/1980 | Doyle | |
| 4,284,313 A | | 8/1981 | Anhalt | |
| 4,296,992 A | | 10/1981 | Gallagher | |
| 4,431,244 A | | 2/1984 | Anhalt et al. | |
| 4,548,158 A | | 10/1985 | Gallusser et al. | |
| 4,703,988 A | | 11/1987 | Raux et al. | |
| 4,875,715 A | | 10/1989 | Dennany, Jr. et al. | |
| 5,082,454 A | | 1/1992 | Tonkiss et al. | |
| 5,181,860 A | | 1/1993 | Honma et al. | |
| 5,192,219 A | | 3/1993 | Fowler et al. | |
| 5,454,728 A | | 10/1995 | Jack | |
| 5,569,053 A | | 10/1996 | Nelson et al. | |
| 5,722,847 A | | 3/1998 | Haag | |
| 5,823,811 A | | 10/1998 | Blanchfield et al. | |
| 5,984,721 A | | 11/1999 | Self, Jr. et al. | |
| 6,039,594 A | * | 3/2000 | Zuppa | 439/318 |
| 6,087,918 A | | 7/2000 | Henry et al. | |
| 6,109,960 A | | 8/2000 | Cooper et al. | |
| 6,143,983 A | | 11/2000 | Burton et al. | |
| 6,168,212 B1 | | 1/2001 | Finley | |
| 6,176,746 B1 | | 1/2001 | Morello et al. | |
| 6,290,525 B1 | | 9/2001 | Jacobi | |
| 6,299,473 B1 | | 10/2001 | Schwarz et al. | |
| 6,350,139 B1 | | 2/2002 | Haag | |

* cited by examiner

*Primary Examiner*—Tho D. Ta
(74) *Attorney, Agent, or Firm*—Thomas N. Twomey

(57) ABSTRACT

A molded twist-lock connector for use in connecting electrical components is composed of a cylindrical connector housing and a cylindrical locking collar, wherein the connector housing has formed therein a plurality of outwardly extending tabs slidably engaged within corresponding circumferentially-elongated slits formed in the locking collar. The tabs are slidably movable within the slits so as to render the locking collar rotatable from an unlocked position to a locked position. The unlocked position of the collar exists when the tabs abut against a first lateral side of the slits and the locked position of the collar exists when the tabs abut against an opposite second lateral side of the slits. The connector is in an unlocked state when the locking collar is disposed in the unlocked position and in a locked state when the collar is disposed in the locked position. The connector is formed as a unit in a single mold, with the tabs being engaged within the slits upon formation of the connector. The connector is particularly useful in automotive applications.

18 Claims, 1 Drawing Sheet

TWIST-LOCK CONNECTOR

This application is based on and claims priority to U.S. Provisional Application No. 60/300,460, filed on Jun. 26, 2001. Provisional Application No. 60/300,460 is incorporated herein by reference in its entirety.

BACKGROUND OF THE INVENTION

The present invention relates to electrical connectors. More particularly, this invention relates to twist-lock electrical connectors.

Electrical connectors are disclosed, e.g., in U.S. Pat. Nos. 3,552,777; 3,786,396; 4,029,953; 4,070,080; 4,074,927; 4,148,542; 4,191,443; 4,284,313; 4,296,992; 4,431,244; 4,548,458; 4,703,988; 4,875,715; 5,082,454; 5,181,860; 5,192,219; 5,454,728; 5,569,053; 5,722,847; 5,823,811; 5,984,721; 6,087,918; 6,104,960; 6,143,983; 6,168,212; 6,176,746; 6,290,525; 6,299,473; and 6,350,139. Twist-lock electrical connectors are disclosed, e.g., in U.S. Pat. Nos. 3,552,777; 4,029,953; 4,703,988;. 5,181,860; 5,722,847; 5,984,721; 6,087,918; 6,143,983; 6,168,212; 6,290,525; and 6,350,139.

Twist-lock electrical connectors are mechanically assisted connectors utilizing rotary motion. Such connectors are typically used to prevent power plugs from accidentally disengaging.

Conventionally, twist-lock electrical connectors are manufactured by separately molding each component of the connector and then combining the components in an assembly process. In some twist-lock connectors, the components are held together by a piece-retaining ring. In other twist-lock connectors, the components are held together by a locking ring integral to the connector housing. In connectors of the latter type, the locking ring is snapped over the connector housing with a high force.

A drawback to conventional twist-lock connectors is that two tools (i.e., molds) are required to produce the components, thereby raising reliability and cost issues.

Another drawback to twist-lock connectors is that the individual components tend to come apart, frequently resulting in loss of one or both components.

Accordingly, a primary object of this invention is to provide an interlocking twist-lock electrical connector which is formed in a single mold, i.e., the individual components or parts are formed simultaneously in the same mold and are disposed in an interlocking state in the molded connector.

A further object of this invention is to provide a twist-lock electrical connector which is cost-effective to make.

Yet another object of this invention is to provide a twist-lock electrical connector which is of durable and reliable construction and wherein the individual components do not tend to come apart.

A still further object of this invention is to provide a twist-lock electrical connector which does not require any tools to perform the locking operation.

These and other objects are achieved in the present invention.

SUMMARY OF THE INVENTION

The present invention provides a molded twist-lock connector containing:

a cylindrical connector housing having: (i) an axial bore with a first open end for receiving a first tubular body and an opposite second open end for receiving a second tubular body; (ii) a side wall defining the axial bore and having an inner surface and an outer surface, the side wall being configured to fittingly engage the first and second tubular bodies; and (iii) a plurality of outwardly projecting tabs formed in the outer surface of the side wall; and a cylindrical locking collar concentrically disposed around a portion of the connector housing, the locking collar having: (i) first and second open ends; (ii) an axial bore for receiving the portion of the housing and being defined between the first and second open ends; (iii) a side wall defining the axial bore and having an inner surface and an outer surface, the inner surface being configured to fittingly engage the outer surface of the side wall of the connector housing; and (iv) a plurality of circumferentially-elongated slits formed in the side wall of the locking collar, the slits being disposed complementary to the tabs formed in the connector housing and being dimensioned and shaped to slidably engage the tabs therein, the tabs being slidably movable within the slits so as to render the locking collar rotatable from an unlocked position to a locked position, the unlocked position of the collar existing when the tabs abut against a first lateral side of the slits and the locked position of the collar existing when the tabs abut against an opposite second lateral side of the slits;

wherein the connector is in an unlocked state when the locking collar is disposed in the unlocked position and in a locked state when the collar is disposed in the locked position.

In the twist-lock connector of this invention, the connector housing and the locking collar are molded in the same tool (mold) as one part. Once the molding process is complete, the connector housing and the locking collar become interlocking parts, free to move independently of one another but restricted in movement by design limits. No assembly is required, and only one molding tool is needed. In addition, the interlocking components do not come apart or become lost. The connector is ready to use when shipped, thus saving time. No tools are required to perform the locking operation.

The connector of this invention is suitable for use in a variety of electrical applications, particularly in the automotive industry.

DETAILED DESCRIPTION OF THE INVENTION

Figure 1:
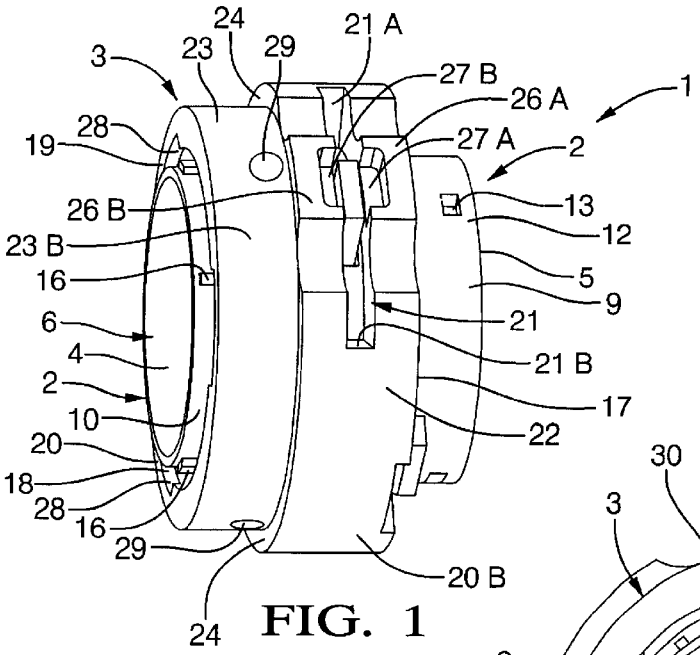
FIG. 1 is a side view of the twist-lock connector of this invention.
Figure 2:
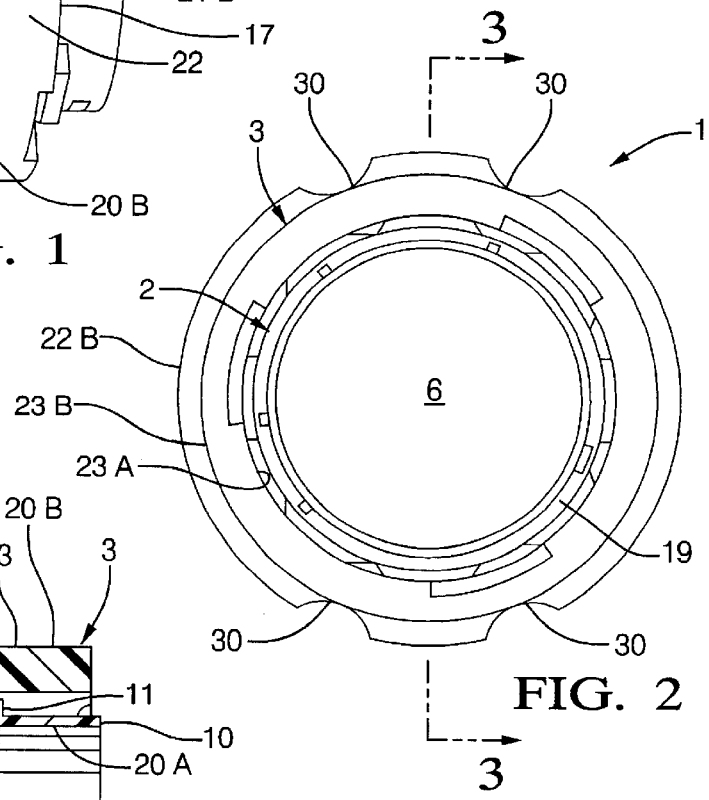
FIG. 2 is a front view of the twist-lock connector of this invention.
Figure 3:
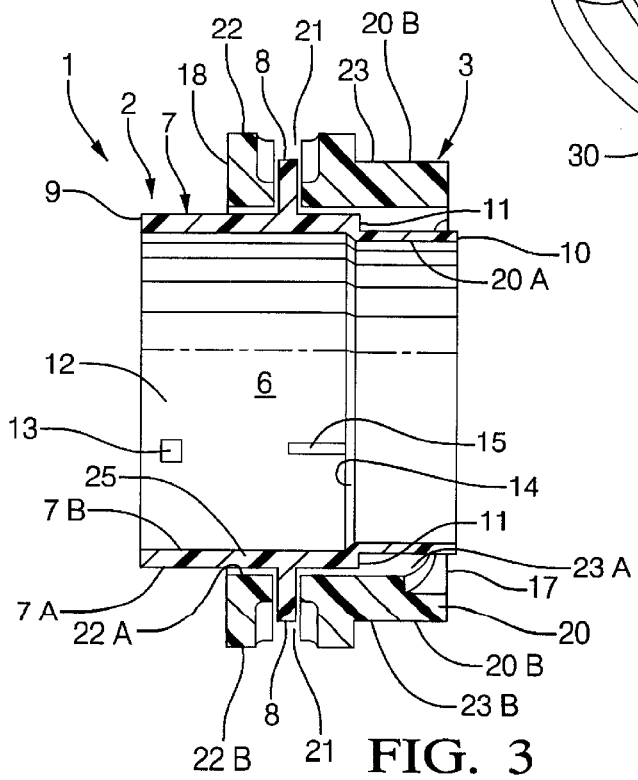
FIG. 3 is a cross-sectional view taken along the line A—A of the twist lock connector shown in FIG. 2.

The twist lock connector of this invention will be described with reference to FIGS. 1–3. In the Figures, the connector is generally designated by the reference numeral 1. The term "tubular bodies" will be used to broadly describe the electrical components which can be joined using the connector of this invention. Non-limiting examples of tubular bodies include, e.g., complementary connector bodies, plugs, receptacles, sockets and the like.

Connector 1 is composed of two primary components: a connector housing 2 and a locking collar 3.

Connector housing 2 is a cylindrical structure having first and second open ends 4, 5; an axial bore 6 extending between the first and second ends, and a side wall 7 defining the axial bore. First and second ends 4, 5 are disposed to receive first and second tubular bodies (not shown).

A plurality of outwarding projecting tabs 8 are formed in an outer surface 7A of connector housing side wall 7. Preferably, outer surface 7A has two tabs 8 formed therein, more preferably two diagonally opposed tabs 8. Tabs 8 are preferably flat structures extending perpendicularly from outer wall surface 7A.

In a particularly preferred embodiment, housing 2 has a step-like configuration composed of a front cylindrical section 9 and a back cylindrical section 10. The outer diameter of section 9 is larger than the outer diameter of section 10, resulting in the presence of an annular flat ledge 11 (constituted by a rear annular surface of section 9) (see FIG. 2) disposed between sections 9 and 10. In this embodiment, tabs 8 are preferably formed in front section 9.

Side wall 7 of housing 2 is configured to fittingly engage the first and second tubular bodies joined by means of the connector of this invention.

In a preferred embodiment, outer surface 7A of side wall 7 will contain in a forward surface 12 of front cylindrical section 9 thereof a plurality of holes 13 shaped and dimensioned to receive corresponding protrusions (not shown) disposed on an outer surface of a first tubular member (not shown). Preferably, surface 12 will have three holes 13 formed therein in a circumferentially-equidistant fashion. Furthermore, inner surface 7B of side wall 7 will preferably have formed therein at a rear surface 14 of front section 9 a longitudinal rib 15 (see FIG. 3) to fittingly engage a corresponding longitudinal rib (not shown) disposed in the first tubular member.

Preferably, a plurality of longitudinal ribs 16 will be formed on outer surface 7A at back cylindrical section 10 (see FIG. 1) to fittingly engage corresponding longitudinal ribs (not shown) disposed on an inner surface of a second tubular member, e.g., a complementary connector body (not shown). Preferably, ribs 16 will be disposed in a circumferentially-equidistant manner on outer surface 7A.

Locking collar 3 is a cylindrical structure concentrically surrounding a portion of housing 2. Collar 3 is composed of first and second open ends 17, 18; an axial bore 19 for receiving the portion of the housing and being defined between ends 17 and 18; a side wall 20 defining the axial bore; and a plurality of circumferentially-elongated slits 21 formed in side wall 20. Side wall 20 has an inner surface 20A and an outer surface 20B, the inner surface being configured to fittingly engage the outer surface 7A of side wall 7 of connector housing 2.

Preferably, locking collar 3 has a step-like configuration composed of a cylindrical front section 22 and a cylindrical back section 23. The outer diameter of front section 22 is larger than the outer diameter of back section 23. Thus, an annular flat ledge 24 (constituted by a rear annular surface of front section 22) is formed between sections 22 and 23.

As stated above, axial bore 19 of collar 3 concentrically surrounds a portion of connector housing 2. Preferably, bore 19 surrounds housing 2 such that front section 22 of collar 3 surrounds a rear portion 25 of the front section 9 of housing 2 and back section 23 of collar 3 surrounds back section 10 of housing 2.

Slits 21 in collar 3 are located complementary to tabs 8 formed in housing 2 and are dimensioned and shaped such that tabs 8 are slidably engaged or seated within slits 21. Slits 21 have a generally rectangular configuration with two lateral sides 21A, 21B and two longitudinal sides 26A, 26B. Two opposite material recesses 27A, 27B are formed along longitudinal sides 26A, 26B, respectively, of each slit. Preferably, recesses 27A. 27B are formed along an intermediate portion of the longitudinal sides of slits 21, as shown in FIG. 1.

Tabs 8 are slidably movable within slits 21 from a first lateral side 21A of slit 21 to an opposite lateral side 21B of the slit. Thus, lateral sides 21A and 21B functions "stops" to the movement of tabs 8 within slits 21.

The ability of tabs 8 to slidably move within slits 21 renders the locking collar 3 partially rotatable relative to connector housing 2. The movement of tabs 8 from lateral side 21A to lateral side 21B causes the collar to rotate from an "unlocked" position to a "locked" position. More specifically, the collar is disposed in its "unlocked" position when the tabs 8 abut lateral side 21A and disposed in its "locked" position when the tabs abut lateral side 21B.

When collar 3 is disposed in its "unlocked" position, connector 1 is in an "unlocked" state, and when the collar is disposed in its "locked" position, the connector is in a "locked" state.

The angular distance over which the collar 3 rotates corresponds to the distance between the lateral sides 21A, 21B of slits 21, i.e., the length of slits 21. Preferably, the length of each of slits 21 is such that the angle at which the collar rotates from its unlocked position to its locked position ranges from about 30° to about 45°.

In collar 3, front cylindrical section 22 has an inner wall 22A and an outer wall 22B, and back cylindrical section 23 has an inner wall 23A and an outer wall 23B. Inner walls 22A and 23A are configured to fittingly engage an outer wall (not shown), of a second tubular body, e.g., a complementary connector body (not shown). Preferably, inner walls 22A and 23A will have formed therein a plurality of (preferably two, more preferably two diagonally opposed) gradual camming ramps (not shown) terminating in step portions 28 (see FIG. 1), wherein the ramps are designed to engage corresponding camming-receiving surfaces (not shown) of a complementary connector body (not shown) or other tubular body.

Also preferably, the outer wall 23B of back section 23 of collar 3 will have formed therein a plurality of (preferably three) holes 29 which are designed to receive therein corresponding protrusions (not shown) of a complementary connector body (not shown).

Preferably, the outer wall 22B of front section 22 of collar 3 will have formed therein at least two pairs of U-shaped longitudinal grooves 30 (preferably two diagonally opposite pairs of grooves 30) to facilitate gripping and rotation of collar 3.

In the process of making the connector of this invention, the connector housing and the locking collar are simultaneously formed in a single mold. In other words, the connector is formed as a unit in a single mold, with the tabs being engaged within the slits upon formation of the connector. Tool steel is brought in from four directions and positioned so as to separate the mold cavity section used to form the connector housing from the mold cavity section used to form the locking collar. Two injection ports are incorporated in the tool so that plastic material can be injected into the two isolated- mold cavity sections. Each mold cavity section has its own gate. Although Gated separately, the two mold cavity sections are filled simultaneously with the plastic used to form the parts. Once the molding process is complete, the connector housing and the locking collar are removed from the mold as a single device wherein the housing and the collar are interlocked by virtue of the retaining tabs of the housing being seated within the circumferential slits of the collar. Although interlocked, the housing and the collar are free to move independently of one another.

The connector of this invention is particularly useful in automotive applications.

All references cited in the instant specification are hereby incorporated by reference herein.

What is claimed is:

1. A molded twist-lock connector, comprising:

a cylindrical connector housing having: (i) an axial bore with a first open end for receiving a first tubular body and an opposite second open end for receiving a second tubular body; (ii) a side wall defining the axial bore and having an inner surface and an outer surface, the side wall being configured to fittingly engage the first and second tubular bodies; and (iii) a plurality of outwardly projecting tabs formed in the outer surface of the side wall; and a cylindrical locking collar concentrically disposed around a portion of the connector housing, the locking collar having: (i) first and second open ends; (ii) an axial bore for receiving the portion of the housing and being defined by the first and second open ends: (iii) a side wall defining the axial bore and having an inner surface and an outer surface of the side wall of the connector housing; and (iv) a plurality of circumferentially-elongated slits formed in the side wall of the locking collar, the slits being disposed complementary to the tabs formed in the connector housing and being dimensioned and shaped to slidably engage the tabs therein, the tabs being trapped and slidably movable within the slits so as to render the locking collar permanently interlocked with the connector housing in an axial direction and rotatable with respect to the connector housing from an unlocked position to a locked position, the unlocked position of the collar existing when the tabs abut against a first lateral side of the slits and the locked position of the collar existing when the tabs abut against an opposite second lateral side of the slits; and wherein the connector is in an unlocked state when the locking collar is disposed in the unlocked position and in a locked state when the collar is disposed in the locked position.

2. A connector according to claim 1, wherein:

the connector housing has a step-like configuration and comprises a front cylindrical section, a back cylindrical section, and an annular flat ledge disposed between the front and back cylindrical sections; the outer diameter of the front cylindrical section being larger than the outer diameter of the back cylindrical section; and the locking collar has a step-like configuration and comprises a cylindrical front section, a cylindrical back section and an annular flat ledge disposed between the front and back cylindrical sections; the outer diameter of the front cylindrical section being larger than the outer diameter of the back cylindrical section.

3. A connector according to claim 1, wherein the connector housing comprises two of said tabs and the locking collar comprises two of said slits.

4. A connector according to claim 3, wherein the tabs are disposed diagonally opposite from one another and the slits are disposed diagonally opposite from one another.

5. A connector according to claim 1, wherein the connector housing has a step-like configuration and comprises a front cylindrical section, a back cylindrical section, and an annular flat ledge disposed between the front and back cylindrical sections; the outer diameter of the front cylindrical section being larger than the outer diameter of the back cylindrical section.

6. A connector according to claim 5, wherein said tabs are formed in the front cylindrical section of the connector housing.

7. A connector according to claim 1, wherein the locking collar has a step-like configuration and comprises a cylindrical front section, a cylindrical back section and an annular flat ledge disposed between the front and back cylindrical sections; the outer diameter of the front cylindrical section being larger than the outer diameter of the back cylindrical section.

8. A connector according to claim 7, wherein said slits are formed in the front cylindrical section of the locking collar.

9. A molded twist-lock connector, comprising:

a cylindrical connector housing having: (i) an axial bore with a first open end for receiving a first tubular body and an opposite second open end for receiving a second tubular body; (ii) a side wall defining the axial bore and having an inner surface and an outer surface, the side wall being configured to fittingly engage the first and second tubular bodies: and (iii) a plurality of outwardly projecting tabs formed in the outer surface of the side wall; and a cylindrical locking collar concentrically disposed around a portion of the connector housing, the locking collar having: (i) first and second open ends; (ii) an axial bore for receiving the portion of the housing and being defined by the first and second open ends: (iii) a side wall defining the axial bore and having an inner surface and an outer surface of the side wall of the connector housing; and (iv) a plurality of circumferentially-elongated slits formed in the side wall of the locking collar, the slits being disposed complementary to the tabs formed in the connector housing and being dimensioned and shaped to slidably engage the tabs therein, the tabs being slidably movable within the slits so as to render the locking collar rotatable from an unlocked position to a locked position, the unlocked position of the collar existing when the tabs abut against a first lateral side of the slits and the locked position of the collar existing when the tabs abut against an opposite second lateral side of the slits;

wherein the connector is in an unlocked state when the locking collar is disposed in the unlocked position and in a locked state when the collar is disposed in the locked position;

wherein the connector housing has a step-like configuration and comprises a front cylindrical section, a back cylindrical section, and an annular flat ledge disposed between the front and back cylindrical sections; the outer diameter of the front cylindrical section being larger than the outer diameter of the back cylindrical section;

wherein the locking collar has a step-like configuration and comprises a cylindrical front section, a cylindrical back section and an annular flat ledge disposed between the front and back cylindrical sections; the outer diameter of the front cylindrical section being larger than the outer diameter of the back cylindrical section; and wherein the front cylindrical section of the locking collar concentrically surrounds a rear portion of the front cylindrical section of the connector housing, and the back cylindrical section of the locking collar concentrically surrounds the back cyindrical section of the connector housing.

10. A connector according to claim 9, wherein said tabs are formed in the front cylindrical section of the connector housing and said slits are formed in the front cylindrical section of the locking collar.

11. A connector according to claim 10, wherein the connector housing comprises two of said tabs and the locking collar comprises two of said slits.

12. A connector according to claim 11, wherein the tabs are disposed diagonally opposite from one another and the slits are disposed diagonally opposite from one another.

13. A molded twist-lock connector, comprising:

a connector housing having an open end for receiving a round body; a side wall having an inner surface adjacent the open end and an outer surface, the inner surface being configured to fittingly engage the round body; and a plurality of outwardly projecting tabs formed in the outer surface of the side wall; and a cylindrical locking collar concentrically disposed around a portion of the connector housing, the locking collar having an open end; an axial bore for receiving the portion of the housing; a side wall defining the axial bore and having an inner surface and an outer surface; and a plurality of circumferentially-elongated slits formed in the side wall of the locking collar, the slits being disposed complementary to the tabs formed in the connector housing;

the tabs being trapped and slidably movable within the slits so as to render the locking collar permanently interlocked with the connector housing in an axial direction and rotatable with respect to the connector housing from an unlocked position to a locked position, the unlocked position of the collar existing when the tabs abut against a first lateral side of the slits and the locked position of the collar existing when the tabs abut against an opposite second lateral side of the slits.

14. The molded twist-lock connector as defined in claim 13 wherein the tabs are solid and the slits are closed at each lateral end.

15. The molded twist-lock connector as defined in claim 14 wherein the connector housing is one of one-piece molded construction and wherein the cylindrical locking collar is of one piece molded construction.

16. The molded twist-lock connector as defined in claim 14 wherein the connector housing and the cylindrical locking collar are molded in the same mold simultaneously.

17. The molded twist-lock connector as defined in claim 14 wherein the connector housing comprises two of said tabs and the locking collar comprises two of said slits.

18. The molded twist-lock connector as defined in claim 17 wherein the tabs are disposed diagonally opposite from one another and the slits are disposed diagonally opposite from one another.

* * * * *